US006597793B1

(12) United States Patent
Darbut et al.

(10) Patent No.: US 6,597,793 B1
(45) Date of Patent: Jul. 22, 2003

(54) DIRECTIONAL/OMNI-DIRECTIONAL HEARING AID MICROPHONE AND HOUSING

(75) Inventors: Alex Darbut, Edina, MN (US); Gerald D. Richels, Blaine, MN (US)

(73) Assignee: Resistance Technology, Inc., Arden Hills, MI (US)

( * ) Notice: Subject to any disclaimer, the term of this patent is extended or adjusted under 35 U.S.C. 154(b) by 0 days.

(21) Appl. No.: 09/130,039

(22) Filed: Aug. 6, 1998

(51) Int. Cl.[7] ..... H04R 25/00

(52) U.S. Cl. ..... 381/313; 381/356; 381/357; 381/355; 381/358

(58) Field of Search ..... 381/313, 322, 381/328, 330, 81, 355, 356, 357, 358, 327

(56) References Cited

U.S. PATENT DOCUMENTS

| | | | | |
|---|---|---|---|---|
| 3,770,911 A | | 11/1973 | Knowles et al. | 179/107 |
| 3,798,390 A | | 3/1974 | Gage et al. | 179/107 |
| 3,835,263 A | | 9/1974 | Killion | 179/107 |
| 3,836,732 A | * | 9/1974 | Johanson | |
| 3,870,820 A | | 3/1975 | Suzuki et al. | 179/1 |
| 3,876,843 A | | 4/1975 | Moen | 179/107 |
| 3,909,556 A | | 9/1975 | Johanson | 179/107 |
| 4,051,330 A | | 9/1977 | Cole | 179/107 |
| 4,142,072 A | | 2/1979 | Berland | 179/107 |
| 4,174,469 A | | 11/1979 | Kusuyama | 179/121 |
| 4,456,795 A | | 6/1984 | Saito | 179/107 |
| 4,629,833 A | | 12/1986 | Kern et al. | 381/68.2 |
| 4,852,177 A | | 7/1989 | Ambrose | 381/154 |
| 5,033,090 A | | 7/1991 | Weinrich | 381/68.4 |
| 5,068,901 A | | 11/1991 | Carlson | 381/68.6 |
| 5,101,435 A | | 3/1992 | Carlson | 381/68.6 |
| 5,201,006 A | | 4/1993 | Weinrich | 381/68 |
| 5,222,050 A | | 6/1993 | Marren et al. | 367/163 |
| 5,319,717 A | | 6/1994 | Holesha | 381/168 |
| 5,524,056 A | | 6/1996 | Killion et al. | 381/68.2 |
| 5,535,282 A | | 7/1996 | Luca | 381/68.6 |
| 5,579,398 A | | 11/1996 | Ewens | 381/154 |
| 6,122,389 A | * | 9/2000 | Grosz | |
| 6,151,399 A | * | 11/2000 | Killion | |

FOREIGN PATENT DOCUMENTS

| | | |
|---|---|---|
| WO | WO 98/30065 | 7/1998 |

OTHER PUBLICATIONS

David Preves, Ph.D., *Directional Microphone Use in ITE Hearing Instrumetns*, The Hearing Review, Jul. 1997, pp. 21–27.

* cited by examiner

*Primary Examiner*—Rexford Barnie
*Assistant Examiner*—Dionne Harvey
(74) *Attorney, Agent, or Firm*—Kinney & Lange, P.A.

(57) ABSTRACT

The present invention includes a compact and economical construction of a microphone wherein the housing is preferably constructed of two identical halves that form a chamber in which the microphone is retained. The housing also includes first and second acoustic passages in an acoustic relationship with the first and second ports of the microphone and extending to an exterior surface of the housing. A switching mechanism is preferably rotatably secured to the housing such that when the switching mechanism is in a first position, the first and second passages are in an acoustic receptive state and when rotated to a second position only one of the acoustic passages is in an acoustic receptive state.

7 Claims, 3 Drawing Sheets

DIRECTIONAL/OMNI-DIRECTIONAL HEARING AID MICROPHONE AND HOUSING

BACKGROUND OF THE INVENTION

The present invention relates to microphones for use in hearing aids, and in particular, it relates to hearing aids that have both omni-directional and/or directional microphone capability.

Hearing aids that have the capabilities of a directional microphone and an omni-directional microphone are advantageous to the user. In certain situations an omni-directional microphone is preferred to a directional microphone and vice versa. For example, in a reverberant environment or in an environment that has background noise, a directional microphone will improve speech intelligibility. Directional microphones are also preferred when the sound source is close to the hearing aid user. In addition, attenuation of sounds coming from the rear provide better listening comfort in a noisy environment. Likewise, in other environments, directionality may not be needed, and in fact, may be a detriment.

For purposes of this application, by directional microphone is meant a microphone having two physically separated acoustic ports which acoustically relate back to opposite sides of a microphone diaphragm. In contrast, an omni-directional microphone has only one acoustic port which acoustically relates to only one side of the microphone diaphragm.

In the past, two microphones have been included in hearing aids, one an omni-directional microphone and the other a directional microphone. The hearing aid user may switch electronically from one to the other. David Preves, *Directional Microphone Use in ITE Hearing Instruments,* The Hearing Review, July 1997; Olson et al., *Performance of SENSO C9 Directional,* Widexpress, July 1997. This type of hearing aid construction has the disadvantage of the cost of two microphones and the added space that two microphones require.

There have also been attempts to provide a hearing aid that permits the user to select between directional or omni-directional modes using one microphone. Such hearing aid constructions are described in the following patents:

| Inventor | Patent No. |
|---|---|
| Killion | 3,835,263 |
| Johanson et al. | 3,836,732 |
| Johanson et al. | 3,909,556 |
| Cole | 4,051,330 |
| Berland | 4,142,072 |

However, the hearing aid constructions in the above mentioned patents are not conducive to a miniature-in-the ear type of hearing aid construction since the switching mechanisms and the acoustic channels take up too much space.

BRIEF SUMMARY OF THE INVENTION

The present invention provides a compact and economical construction of a microphone and housing wherein the user can select between a directional or an omni-directional mode. The microphone is disposed in a housing preferably constructed of two identical halves wherein each housing half includes an acoustic passage. The microphone has first and second acoustic ports and is disposed within the housing in an acoustic relationship with the first and second acoustic passages of the housing, respectively. A switching mechanism is preferably rotatably secured to the housing in an acoustic relationship with the first and second acoustic passages of the housing and is rotatable between a first position wherein the first and second acoustic passages of the housing are in an acoustic receptive state and a second position where either the first passage or the second passage of the housing is blocked by the switching mechanism such that only one of the passages is in an acoustic receptive state.

DETAILED DESCRIPTION OF THE PREFERRED EMBODIMENTS

Figure 1:
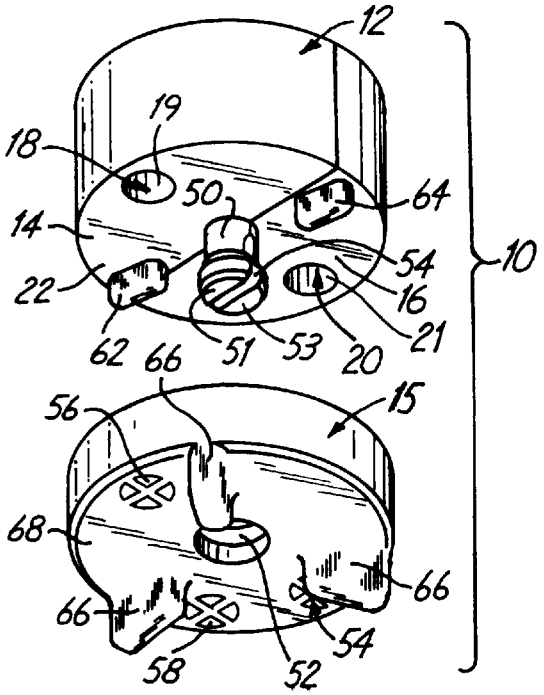
FIG. 1 is an exploded perspective view of the microphone housing and the switching mechanism of the present invention.

The present invention provides in a hearing aid selectability between an omni-directional and a directional microphone mode in an economic and compact construction. Referring to FIG. 1 of the drawings, the hearing aid construction 10 of the present invention is generally indicated at 10. The hearing aid construction 10 includes a housing 12 and a mechanical switching mechanism 15. As further illustrated in FIG. 2, the housing 12 preferably includes matching and preferably identical housing halves 14 and 16. Each housing half 14 and 16 includes an acoustic passage 18 and 20, respectively. The acoustic passages 18 and 20 extend from a common exterior surface 22 of the housing 12 as indicated by exterior openings 19 and 21 respectively, as best illustrated in FIG. 1. The acoustic passages 18 and 20 extend from the exterior openings 19 and 21 to interior openings 24 and 25 as best illustrated in FIG. 3.

A directional microphone 26 is positioned within a microphone chamber 28 that is formed by the housing halves 14 and 16. The directional microphone 26 is of standard construction having first and second acoustic ports 30 and 32 disposed on opposite sides of a diaphragm (not shown). The acoustic ports 30 and 32 are positioned to be in an acoustic relationship with the acoustic passages 18 and 20 through openings 24 and 25 of the housing halves 14 and 16, all respectively, when the microphone 26 is positioned within the chamber 28.

Figure 2:
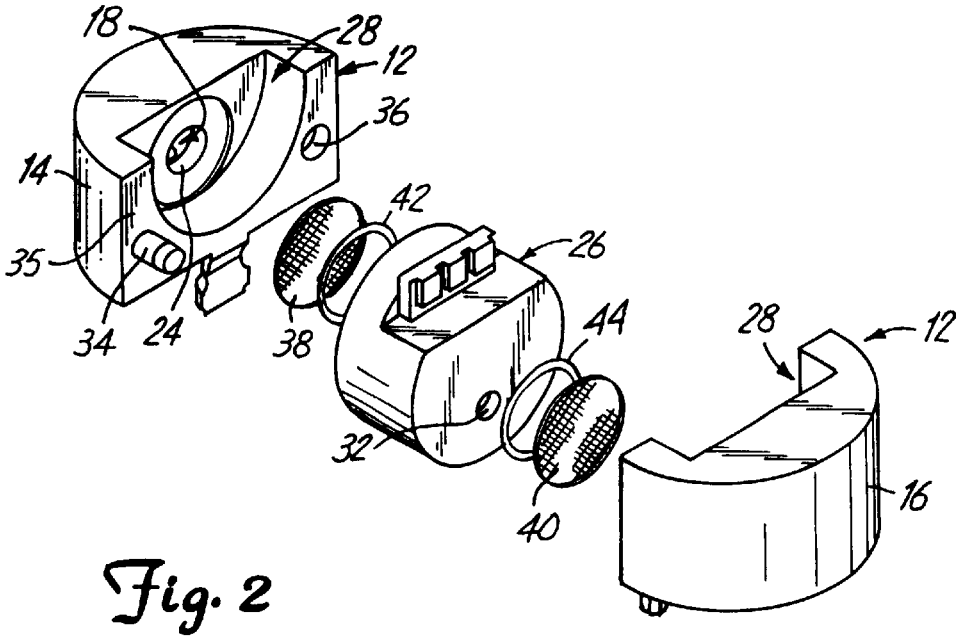
FIG. 2 is an exploded perspective view of the microphone housing and microphone of the present invention.
Figure 3:
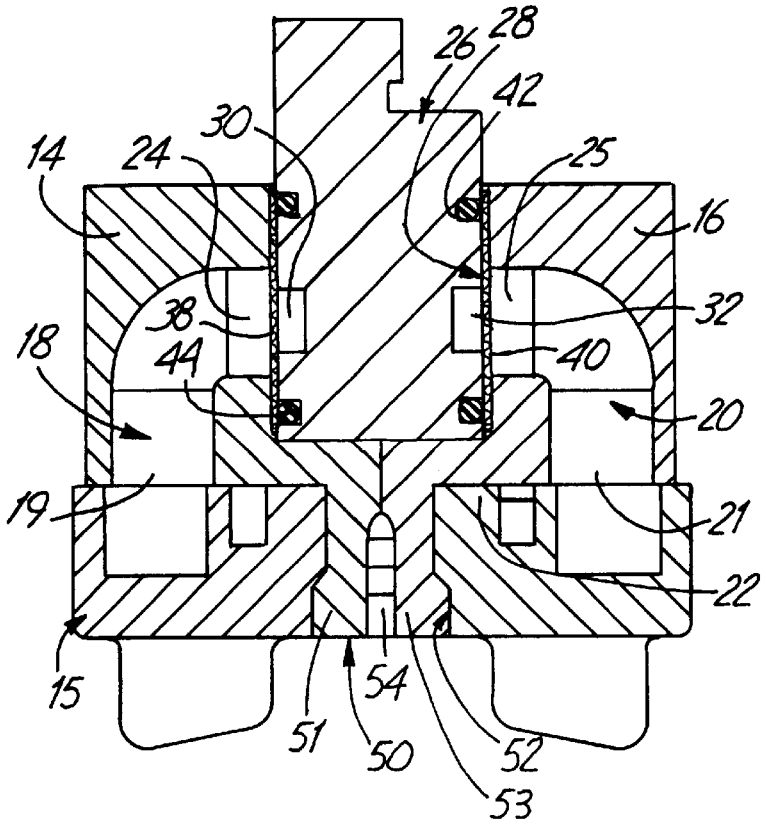
FIG. 3 is a sectional view of the microphone and housing of the present invention.

The housing halves 14 and 16 may be joined together by any suitable method such as adhesive, ultrasonic welding or as illustrated in FIG. 2, in which each housing half includes a male pin 34 extending from an interior surface 35 and a mating hole or female member 36 disposed on the same surface of the same housing half to receive a male member (not shown) similar to male member 34 and the male member (not shown) extending from the other housing half 16. Similarly, the housing half 16 also has a mating hole or a female member (not shown) similar to female member 36 of the housing 12 and positioned to receive the male member 34. The male members are of a size and shape to snap fit within the respective female members to secure the housing halves 14 and 16 together to form the housing 12.

Acoustic dampers 38 and 40 are positioned adjacent to the openings 24 and 25, respectively. Alternatively, the dampers 38 and 40 can be positioned inside the microphone or at the entrance of openings 19 and 21. O-rings 42 and 44 are disposed between the dampers 38 and 40 and the acoustic ports 30 and 32, as best illustrated in FIG. 3. The O-rings are made of a compressable polymer such as a natural or synthetic rubber and are necessary to provide a tight acoustic seal. The O-rings 42 and 44 eliminate any leakage due to variation in construction of the housing halves and the microphone and dimensional variations that may result from snapping together the housing halves 14 and 16. The O-rings 42 with the acoustic passages 18 and 20 being part of the housing 12 provide a very efficient acoustic path with virtually no leakage. Alternatively, an ultraviolet stabilized silicone adhesive may be used instead of O-rings 42 to provide an acoustic seal.

A male connecting pin member 50 extends from the housing surface 22. The male member 50 is positionable within a receiving aperture 52 in the switching mechanism 15. The male member 50 is comprised of two halves each extending from housing halves 14 and 16, respectively, and which are joined together when the two housing halves are snap fitted to create the housing 12 and the chamber 28 for the microphone 26. A slot 54 extends through the center of the male pin member 50 and defines two prong sections 51 and 53 that are pushed toward each other as the pin member 50 is inserted within the receiving aperture 52.

As best illustrated in FIG. 3, the member 50 has a frusto conical end portion and receiving aperture 52 has a frusto conical female shaped end portion which is configured to mate with the member 50. It will be appreciated that the prong sections 51 and 53 bend inwardly as the frusto conical end portion of the male member is inserted into the initial narrower section of the receiving aperture 52 and then extend outwardly when the frusto conical end portion of the male member is inserted into the frusto conical section of the aperture 52 due to the inherent spring force of the prong sections 51 and 53. The annular incline of the frusto conical member 50 in cooperation with the spring force of the prong sections 51 and 53 provides a force that pushes the switching mechanism against the surface 22 of the housing 14.

Figure 4:
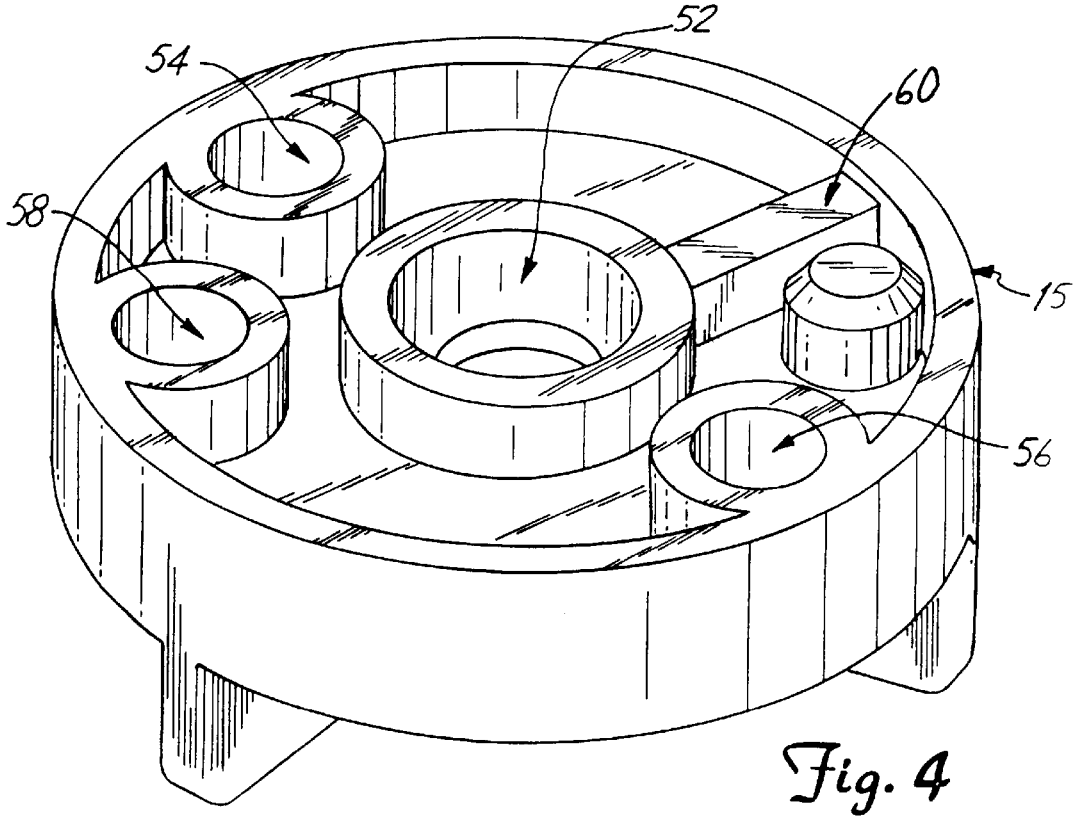
FIG. 4 is a perspective view of one side of the switching mechanism of the present invention.

The switching mechanism 15 preferably has a circular perimeter corresponding to the general circumference and diameter of the housing 12 and is preferably rotatable about the member 50. The switching mechanism 15 includes acoustic switching ports 54, 56 and 58, and a plugged port 59 as best illustrated in FIG. 4 and a stop member 60 extending in a direction towards the surface 22 when the switching mechanism 15 is rotatably secured to the housing 12.

Stop tabs 62 and 64 are disposed on the surface of the housing 12, each tab extending from respective housing halves 14 and 16. The tabs 62 and 64 extend toward the switching mechanism 15 such that when the mechanism 15 is secured to the housing 12, the tabs 62 and 64 will be engaged by the stop member 60. A plurality of finger tabs 66 extend from an outer surface 68 of the switching mechanism 15 such that the tabs are engagable by a human finger or an instrument such as a screwdriver for rotating the switching mechanism 15.

Figure 5:
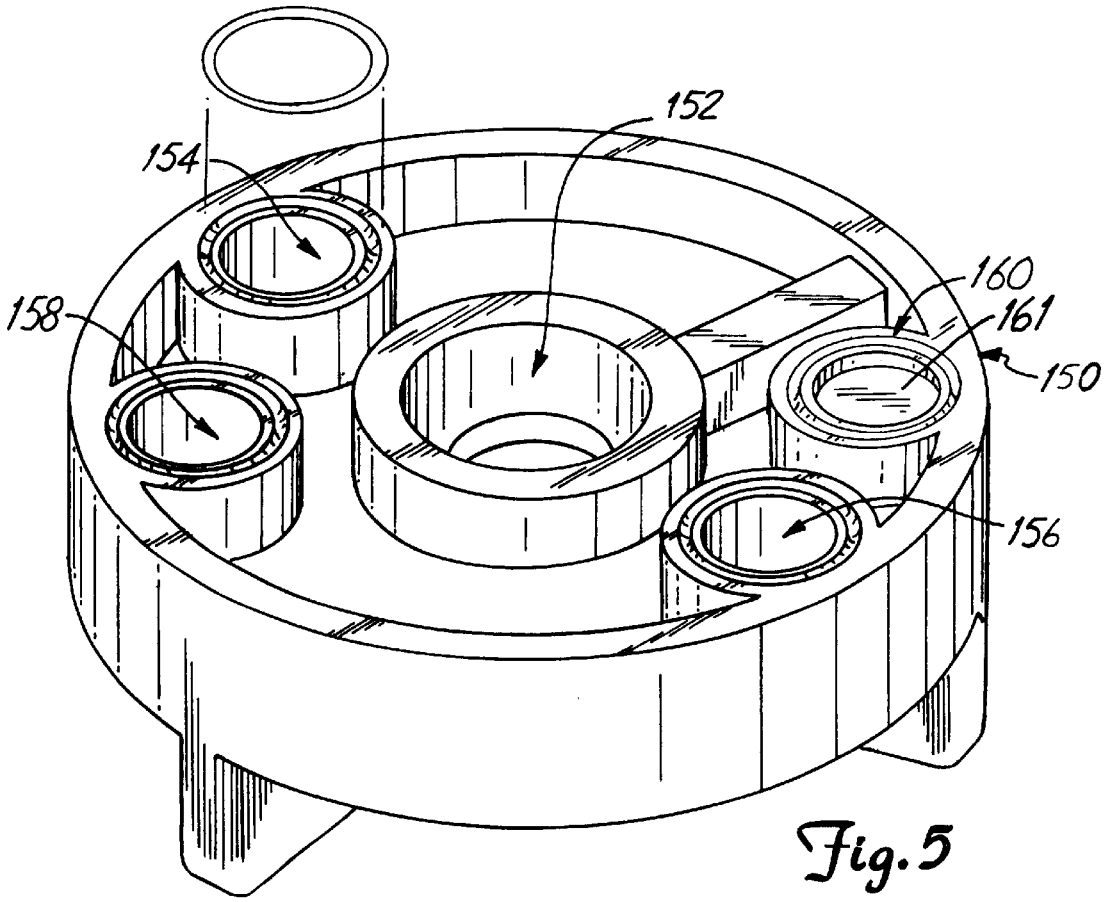
FIG. 5 is a perspective view of an alternative embodiment of the present invention.
Figure 6:
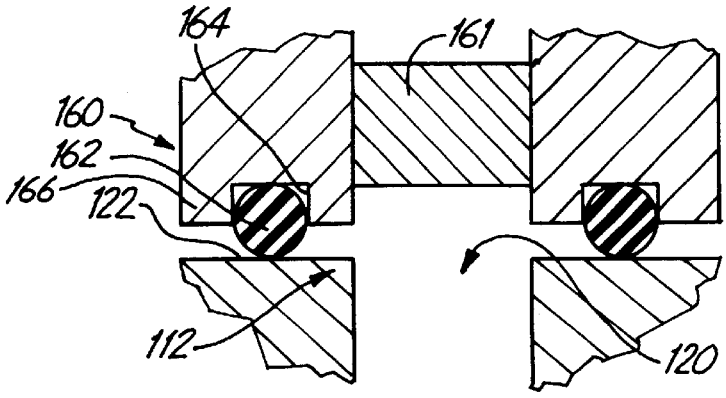
FIG. 6 is a sectional view of a blockage port of FIG. 5.

In an alternative embodiment, as illustrated in FIGS. 5 and 6, the switching mechanism 150 includes three acoustic ports 154, 156 and 158 and an acoustic blocking port 160. The switching mechanism 150 is otherwise identical to the switching mechanism 15 of FIG. 4 except for the following variation. Each of the acoustic ports 154, 156 and 158 and the acoustic blocking port 160 have an O-ring 162 positioned within a recess 164 of a distal end 166, as illustrated in FIG. 6 wherein only the acoustic blocking port is illustrated. The acoustic ports 154, 156 and 158 are identically configured with respect to the O-ring 162. The O-ring 162 of each of the acoustic ports 154, 156 and 158 and the acoustic block port 160 are in an acoustic sealing relationship with the exterior surface 22 of housing 12. Therefore, when the ports 154 and 156 are aligned respectively with both acoustic passages that are in acoustic relationship with the microphone, the hearing aid construction of the present invention is in a directional microphone state. When the acoustic port 158 and the acoustic block port 160 are aligned with the acoustic passages, then since only one acoustic passage is connected with one acoustic port, the hearing aid construction of the present invention is in an omni-directional mode. As illustrated in FIG. 6, the blocking acoustic port includes a blockage 161 which prevents any acoustic waves to enter the passage and affect the microphone.

When the switching mechanism 15 is secured to the housing 12, as best illustrated in FIG. 3, the switching mechanism 15 is rotatable to a position in which the stop member 60 engages stop tab 62. When the member 60 engages tab 62, the microphone construction of the present invention is in a directional mode with acoustic switching port 54 in an acoustic relationship with acoustic passage 20 and acoustic switching port 56 in an acoustic relationship with acoustic passage 18. When the switching mechanism 15 is rotated in an opposite direction such that the member 60 engages stop tab 64, the switching ports 54 and 56 are disconnected from an acoustic relationship with the acoustic passages 18 and 20 while switching port 58 is positioned in an acoustic relationship with acoustic passage 20 thereby placing the microphone construction of the present invention in an omnidirectional mode. The acoustic passage 18 when the microphone construction of the present invention is in the omni-directional mode is blocked by plugged port 59 from receiving sound by the switching mechanism 15.

Although the present invention has been described with reference to preferred embodiments, workers skilled in the art will recognize that changes may be made in form and detail without departing from the spirit and scope of the invention.

What is claimed is:

1. A microphone construction for use in a hearing aid, the construction comprising:

a housing formed from first and second matching housing halves joined together, the first housing half having a first acoustic passage and the second housing half having a second acoustic passage, the housing halves having a microphone retaining chamber;

a microphone disposed in the microphone retaining chamber and having first and second acoustic ports positioned to be in an acoustic relationship with the first and second acoustic passages; and a switching mechanism secured to the housing and movable between a first position wherein the first and second acoustic passages are in an acoustic receptive state and a second position when the first passage is blocked by the switching mechanism and the second passage is an acoustic receptive state.

2. The construction of claim 1 wherein the switching mechanism is rotatably secured to the housing and is rotatable between the first position and the second position.

3. The construction of claim 2 and further including first and second acoustic ports within the switching mechanism being in an acoustic relationship with the acoustic passage of the first and second housing halves when the switching mechanism is in the first position, and a third acoustic port for being in an acoustic relationship with the first acoustic passage when the switching mechanism is in the second position.

4. The construction of claim 3 wherein O-rings are secured to the first, second and third acoustic ports such that the acoustic ports are in a sealing relationship with a surface of the housing providing an acoustic seal with the first and second acoustic passages when in the first position and an acoustic seal when in the second position between the third acoustic port and second passage.

5. The construction of claim 2 wherein the switching mechanism includes a plurality of outwardly projecting tabs for engagement to rotate the switching mechanism between the first and second positions.

6. The construction of claim 2 and further including first and second stop tabs projecting outwardly from the housing and a stop member projecting from the switching mechanism, the stop member engaging the first stop tab thereby positioning the switching mechanism in the first position and whereby when the switching mechanism is rotated the stop member engages the second stop tab to position the switching mechanism in the second position.

7. The construction of claim 2 and further including first and second O-rings being disposed between the first and second ports of the microphone and the first and second acoustic passages of the housing to provide an acoustic seal.

* * * * *